US011834928B1

(12) United States Patent
Tian et al.

(10) Patent No.: US 11,834,928 B1
(45) Date of Patent: Dec. 5, 2023

(54) DRILL STRING ROTATION CONTROLLER FOR DIRECTIONAL DRILLING

(71) Applicants: Southwest Petroleum University, Chengdu (CN); Sichuan Xieming Technology Co., Ltd., Chengdu (CN)

(72) Inventors: Jialin Tian, Chengdu (CN); Haolin Song, Chengdu (CN); Yinglin Yang, Chengdu (CN); Yanniu Ren, Chengdu (CN); Lin Yang, Chengdu (CN); Zhe Zhang, Chengdu (CN); Bo He, Chengdu (CN); Jun Li, Chengdu (CN); Yu Wei, Chengdu (CN); Lei Cha, Chengdu (CN)

(73) Assignees: Southwest Petroleum University, Chengdu (CN); Sichuan Xieming Technology Co., Ltd., Chengdu (CN)

( * ) Notice: Subject to any disclaimer, the term of this patent is extended or adjusted under 35 U.S.C. 154(b) by 0 days.

(21) Appl. No.: 17/936,141

(22) Filed: Sep. 28, 2022

(51) Int. Cl.
*E21B 4/02* (2006.01)
*E21B 4/14* (2006.01)
*E21B 4/00* (2006.01)

(52) U.S. Cl.
CPC ..... *E21B 4/02* (2013.01); *E21B 4/003* (2013.01); *E21B 4/14* (2013.01)

(58) Field of Classification Search
CPC ..... E21B 4/02; E21B 4/003; E21B 4/14
See application file for complete search history.

(56) References Cited

U.S. PATENT DOCUMENTS

| | | | | |
|---|---|---|---|---|
| 3,586,116 | A * | 6/1971 | Tiraspolsky | E21B 7/067 175/256 |
| 5,048,621 | A * | 9/1991 | Bailey | E21B 7/067 175/320 |
| 5,495,900 | A * | 3/1996 | Falgout, Sr. | E21B 4/02 175/325.2 |
| 7,287,607 | B1 * | 10/2007 | Falgout, Sr. | E21B 7/068 175/74 |
| 9,347,269 | B2 * | 5/2016 | Marchand | E21B 17/04 |
| 2002/0053470 | A1 * | 5/2002 | Noe | E21B 7/062 175/62 |
| 2020/0199994 | A1 * | 6/2020 | Jeffryes | E21B 44/00 |
| 2022/0186567 | A1 * | 6/2022 | Fox | E21B 7/068 |
| 2022/0316312 | A1 * | 10/2022 | Zheng | E21B 44/04 |

* cited by examiner

*Primary Examiner* — Yong-Suk (Philip) Ro
(74) *Attorney, Agent, or Firm* — Andrew D. Fortney; Central California IP Group, P.C.

(57) ABSTRACT

A drill string rotation controller includes an anti-torque balance module, a TC bearing retaining ring, an upper TC bearing, an upper thrust ball bearing, an upper Haval ring, a middle seal retaining ring, an upper mandrel, an upper shell, a rotary control cylinder, an upper spring, a spline shell, a spline sleeve, a spline mandrel, a lower shell, a spring push sleeve, a lower spring, a floating piston, a lower mandrel, a bulkhead, a lower thrust ball bearing, a lower Haval ring, a lower TC bearing, a conversion joint, an anti-drop joint, a lower joint, and a control pin. The rotary control cylinder causes the spline sleeve to switch the transmission relationship between the spline mandrel and shell. Therefore, the drill string rotation controller controls the conversion between the composite drilling mode and the directional drilling mode.

11 Claims, 3 Drawing Sheets

A – A

B - B

DRILL STRING ROTATION CONTROLLER FOR DIRECTIONAL DRILLING

TECHNICAL FIELD

The invention relates to a drill string rotation controller for directional drilling, which is used in drilling engineering, such as petroleum, natural gas, shale oil, shale gas, geothermal energy and other geological resources exploration and exploitation.

BACKGROUND OF THE INVENTION

Current directional drilling technology mainly includes two types of drilling: sliding drilling and rotary steerable drilling. In sliding drilling, the upper drill string, fixed by a rotary table, is in stationary contact with a borehole wall, and a bottom downhole motor defines the directional orientation and the control tools' face by adjusting the inclination angle, which is related to the drill bit type and the rock being drilled. The problems of this method include the unstable anti-torque generated during the rock breaking process, which is transmitted to the power motor and drill string system, causes the drilling tool to rotate in reverse, and results in unstable tool face, thus affecting wellbore wall quality and directional trajectory control ability. More seriously, sliding drilling causes serious friction between the drill string and borehole wall, which decreases the WOB (weight on bit), drilling efficiency and ROP (rate of penetration), and increases the difficulty of wellbore trajectory control, and reduces the rock cuttings circulation capacity driven by drilling mud. Compared with this, rotary steerable drilling can improve drilling efficiency greatly, but its cost is higher, especially in the event of drill string stick slip or downhole accidents.

Therefore, considering these backgrounds of both sliding drilling and Rotary Steerable (RSS) drilling, we present this invention, a drill string rotation controller for directional drilling, which can reduce the wellbore friction and improve the WOB, ROP and drilling efficiency greatly.

SUMMARY OF THE INVENTION

The present drill string rotation controller for directional drilling can convert the drill string to rotary mode during directional drilling, and control the anti-torque. The drill string rotation controller for directional drilling can improve the efficiency of directional drilling, and reduce the cost of normal drilling or accident situation.

The purpose of the present invention is to provide a drill string rotation controller for directional drilling with a compound drilling function, higher efficiency and higher reliability for directional drilling.

In order to achieve the purpose of the invention, the technical scheme adopted by the invention includes a drill string rotation controller for directional drilling that comprises a spline group module that controls a directional drilling tool and is convertible between rotary steerable drilling and sliding drilling (e.g., the directional drilling tool has a rotary steerable mode and a sliding mode), and an anti-torque balance module that controls an anti-torque (e.g., from the geological formation being drilled) to the drill bit during the rock-breaking process.

Preferably, in the above-mentioned directional drill string rotation controller of the present invention, the anti-torque balance module comprises an upper joint, a wear-resistant ring, a roller shell, a roller, a roller spring, a spring base, and a shell joint. The module is connected to an upper bearing module and a control cylinder module.

Preferably, in the above-mentioned drill string rotation controller of the present invention, the control cylinder module is a key component of the drill string rotation controller, which comprises a rotary control cylinder, an upper spring, and a control pin. When a drilling fluid enters a cavity in the drill string rotation controller, an upper end face of the rotary control cylinder is under pressure. By adjusting the drilling fluid pressure, the upper spring can be compressed and/or reset, and the control pin limits movement and a position of the rotary control cylinder.

Preferably, in the above-mentioned drill string rotation controller of the present invention, the spline group module comprises a spline mandrel, a spline shell, and a spline sleeve. The spline sleeve has an inner spline and an outer spline. The spline mandrel has an outer spline, and the spline shell has an inner spline. The inner spline of the spline sleeve meshes with the spline mandrel, and the outer spline of the spline sleeve meshes with the spline shell. The spline mandrel is connected with an upper mandrel and a lower mandrel, and the upper mandrel, the spline mandrel, and the lower mandrel are all fastened by one or more screws. The spline group module is connected to the control cylinder module. The upper mandrel is connected to the upper joint, and the upper joint is connected to an upper drill string. The upper drill string transmits a driving torque to the upper mandrel through the upper joint. The upper mandrel drives the spline mandrel to rotate synchronously (e.g., with the upper mandrel), and the spline mandrel drives the lower mandrel to rotate synchronously (e.g., with the spline mandrel). The control pin in the control cylinder module moves slidingly in the control cylinder under pressure (e.g., from a pump), so as to control the control pin's position in the control cylinder, to change the spline sleeve's position in the control cylinder, and to control the spline sleeve meshing with the spline mandrel and/or the shell, which enables compound drilling and/or multiple drilling modes, determined by the controller.

Preferably, in the above-mentioned drill string rotation controller of the present invention, the upper mandrel is externally connected to the upper bearing module consisting of a TC (tungsten carbide) bearing retaining ring, an upper TC bearing, an upper thrust ball bearing, an upper Haval ring, and an intermediate sealing retaining ring, and the lower mandrel is connected to the lower bearing module. The lower bearing module comprises a lower thrust ball bearing, a lower Haval ring and a lower TC bearing. The upper and lower bearing modules can isolate the rotation between the shell and the mandrel of the drill string rotation controller, and enable independent rotation of the shell and the mandrel.

Preferably, in the above-mentioned drill string rotation controller of the present invention, the spline group module is connected to the lower spring module consisting of a lower shell, a spring push sleeve and a lower spring, and the lower spring module is connected to a floating piston and a bulkhead. When the directional drilling rotary controller changes from, for example, a compound drilling state to a directional drilling mode, the lower spring module assists the upper spring in the control cylinder module to reset the spline sleeve. Thereby, the spline sleeve demeshes with the spline mandrel and the spline shell.

Preferably, in the above-mentioned drill string rotation controller of the present invention, when the spline group module is meshed, the drill string rotation controller can realize compound drilling without balancing the anti-torque, but the anti-torque balance module may not work. When the spline group module is un-meshed, the drill string rotation controller enables directional drilling, and the anti-torque balance module can operate (e.g., to allow the roller shell to bear the anti-torque force[s]).

Compared with the existing technology, the present invention has the following beneficial effects: the drill string rotation controller can change between compound drilling and directional drilling, reduce the risk of sticking, and facilitate the cleaning of the wellbore. The drill string rotation controller can reduce friction, reduce viscosity and prevent stick-slip, improve ROP, and increase the service life of drilling tools. The drilling fluid medium used in the pump (e.g., to change the pressure) is easy to use.

In the Figures: 1—upper joint, 2—wear ring, 3—roller shell, 4—shell joint, 5—TC bearing retaining ring, 6—upper TC bearing, 7—upper thrust ball bearing, 8—upper Haval ring, 9—the middle sealing retaining ring, 10—upper mandrel, 11—upper shell, 12—rotary control cylinder, 13—upper spring, 14—spline shell, 15—spline sleeve, 16—spline mandrel, 17—lower shell, 18—spring push sleeve, 19—lower spring, 20—floating piston, 21—lower mandrel, 22—bulkhead, 23—lower thrust ball bearing, 24—lower Haval ring, 25—lower TC bearing, 26—conversion joint, 27—anti-drop joint, 28—lower joint, 29—roller, 30—roller spring, 31—spring base, 32—control pin.

DETAILED DESCRIPTION OF THE INVENTION

Figure 1:
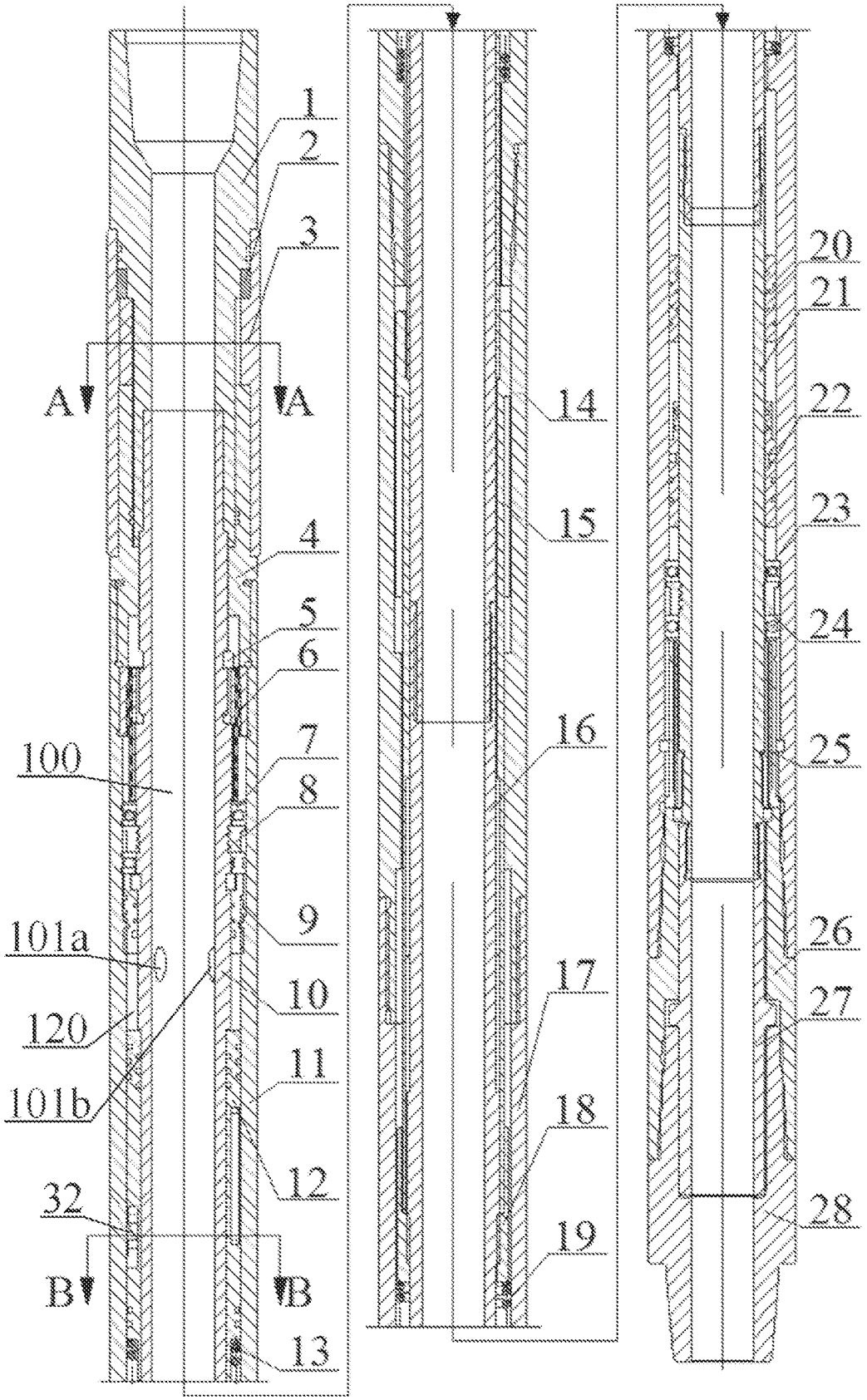
FIG. 1 is an elevation view of a directional drill string in accordance with the present invention.
Figure 2:
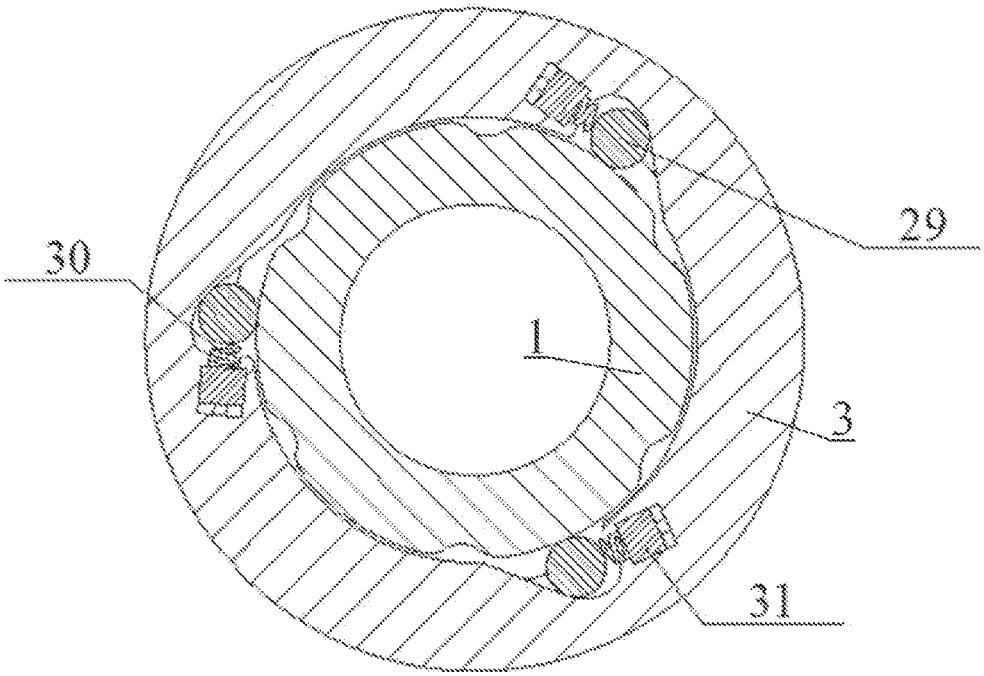
FIG. 2 is cross-sectional view of the directional drill string of FIG. 1 along the line A-A.
Figure 3:
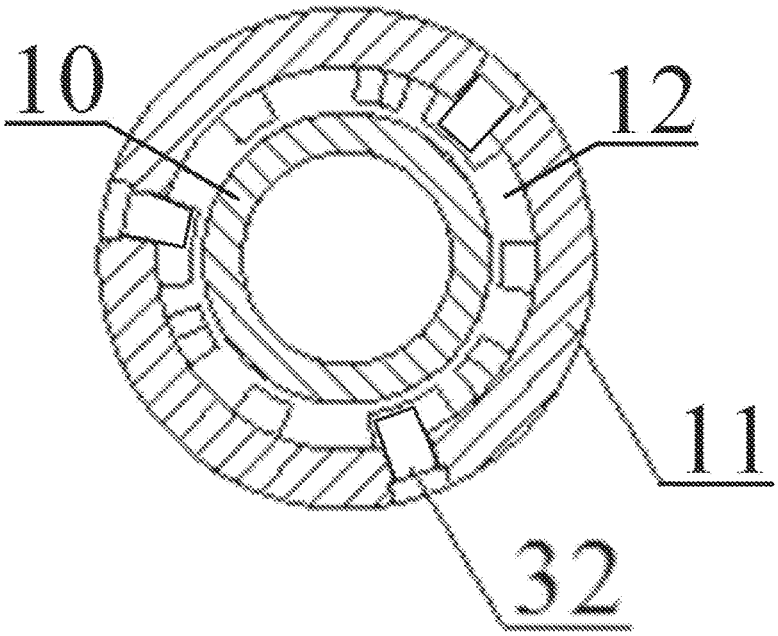
FIG. 3 is cross-sectional view of the directional drill string of FIG. 1 along the line B-B.

As illustrated in FIGS. 1-3, the assembly sequence for the drill string rotation controller for directional drilling is: assemble the upper spring 13 and the rotary control cylinder 12 together, and then install them into the upper shell 11 together; pre-press the upper spring 13 and install the control pin 32 to form the upper shell assembly; and the rotary control cylinder 12, the upper spring 13, and the control pin 32 form the control cylinder module. The TC bearing retaining ring 5, the middle sealing retaining ring 9, the upper thrust ball bearing 7, the upper Haval ring 8, the upper thrust ball bearing 7, and the inner ring of the upper TC bearing 6 are sequentially installed on the upper mandrel 10; the TC bearing retaining ring 5, the middle sealing retaining ring 9, the upper thrust ball bearing 7, the upper Haval ring 8, the upper thrust ball bearing 7, and the upper TC bearing 6 form the upper bearing module. Assemble the upper shell assembly to the upper mandrel 10, and install the outer ring of the upper TC bearing 6. Install the wear ring 2 to the upper joint 1, assemble the roller spring 30 and the spring base 31, then install them on or in the roller shell 3, then attach the roller shell 3 to the upper joint 1, and then install the roller 29. Assemble the shell joint 4 and the upper shell 11, and fasten the threaded connection between the upper joint 1 and the upper shell 11. The upper joint 1, the wear ring 2, the roller shell 3, the roller 29, the roller spring 30, the spring base 31, and the shell joint 4 form the anti-torque balance module. Attach or connect the assembled anti-torque balance module to the upper mandrel 10 to the roller shell 3 and the shell joint 4, thereby clamping the roller shell 3 and/or the upper joint 1. Assemble the spline sleeve 15 with the spline mandrel 16, then assemble the spline mandrel 16 with the upper mandrel 10, and fasten the threaded connection between the upper mandrel 10 and the spline mandrel 16. Push the spline sleeve 15 upward, assemble the spline shell 14 and the upper shell 11, and fasten the threaded connection between the spline shell 14 and the upper shell 11. The spline shell 14, the spline sleeve 15 and the spline mandrel 16 form the spline group module. Assemble the spring push sleeve 18 and the lower spring 19 with the spline mandrel 16, then the lower shell 17 is assembled, fasten the threaded connection between the spline shell 14 and the lower shell 17. The lower shell 17, the spring push sleeve 18 and the lower spring 19 form the lower spring module. Assemble the floating piston 20 into the lower shell 17, then assemble the bulkhead 22 into the lower shell 17, and fasten them. Assemble the lower thrust ball bearing 23, the lower Haval ring 24, the lower TC bearing 25 with the lower mandrel 21. The lower thrust ball bearing 23, the lower Haval ring 24, and the lower TC bearing 25 form the lower bearing module. Assemble the conversion joint 26 with the anti-drop joint 27, and then connect the lower mandrel 21 and the anti-drop joint 27 using one or more screws. The assembled lower mandrel 21 is assembled with the splined mandrel 16, and finally the lower joint 28 is assembled.

The working process of the drill string rotation controller is as follows. Connect the drill string rotation controller to the drill string system and check the tool action status. Go down the drilling tool and start the mud pump after reaching the bottom of the well. Apply pump pressure (e.g., increase the pressure) to the tool. In general, the pressure in the tool is increased by pumping a drilling fluid into the internal cavity 100 of the drill string. The drilling fluid passes through holes 101*a-b* in the upper mandrel 10, into a cavity or well 120 between the upper mandrel 10 and the upper shell 11. After the pressure reaches an initial required working pressure threshold, the drilling fluid pressure pushes the rotary control cylinder 12 down. The sliding path on the rotary control cylinder 12 cooperates with the control pin 32 to push the spline group module to mesh. The upper drill string transmits the torque and rotary speed to the upper shell 11, the lower shell 17 and the lower joint 28 through the spline group module, and then the drill string rotation controller drives the bottom hole assembly (BHA) to rotate together to realize compound drilling. During directional drilling, the pump pressure is reduced, the rotary control cylinder 12 and the spline group module move upward in the axial direction under the action of the upper spring 13 and the lower spring 19, and the spline group module demeshes. The pump pressure is increased again, the spline group module remains un-meshed, the upper drill string realizes rotary drilling, and the BHA realizes directional sliding drilling. The above process is repeated to realize the transition between the meshed state and un-meshed state of the spline group module.

Figure 4:
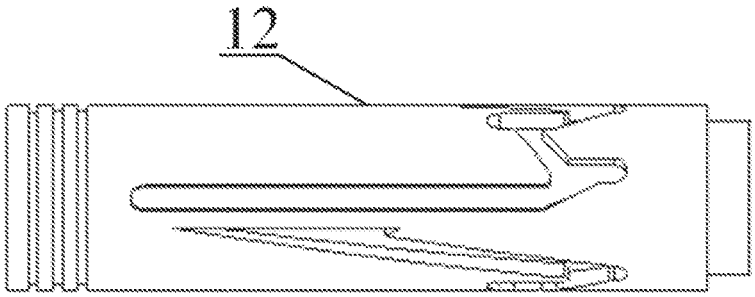
FIG. 4 shows a diagram of the sliding path in a rotary control cylinder in accordance with the present invention.
Figure 5:
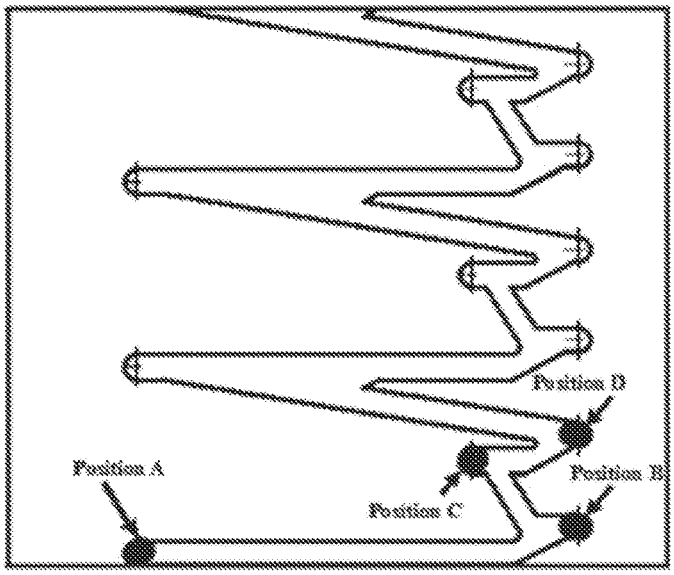
FIG. 5 is a schematic diagram of the sliding path shown in FIG. 4.

The rotary control cylinder 12 is a key component for transitioning or changing between the meshed state and un-meshed state. The sliding path in the rotary control cylinder 12 is shown in FIG. 4. An unfolded version of the sliding path of the rotary control cylinder 12 is shown in FIG. 5. The control pin 32 has four state positions of different vertices in the sliding path, namely position A, position B, position C, and position D, and the remaining vertices are periodically repeated positions of the four points.

Referring to FIG. 5, the working process of the drill string rotation controller is further described. The drill string rotation controller goes down the well. With the pump pressure increasing, the rotary control cylinder 12 moves down, and the control pin 32 is located at the top of the sliding path of the rotary control cylinder 12 (that is, position A). At this time, the rotary control cylinder 12 pushes the spline sleeve 15 down, the inner splines of the spline sleeve 15 mesh with the outer splines of the spline mandrel 16, and the outer splines of the spline sleeve 15 mesh with the inner splines of the spline shell 14, so as to realize the meshing or meshed state of the drill string rotation controller. When the pump pressure is stable or fluctuates slightly, the drill string rotation controller remains in a stable state of meshing to achieve stable compound drilling. If it is necessary to switch from compound drilling to directional drilling, reduce pump pressure. Under the action of the upper spring 13 and the lower spring 19, the spline sleeve 15 and the rotary control cylinder 12 move upward, the control pin 32 moves from position A to position B, and the spline sleeve 15 moves out of the meshed state. At this time, the drill string rotation controller is in an un-meshed state, but the position B is in an unstable un-meshed state. The pump pressure is then increased, and the control pin 32 moves to the position C of the sliding path. At this time, the drill string rotation controller is in a stable meshing state. Even if the pump pressure fluctuates, the sliding path of the rotating control cylinder 12 and the position of the control pin 32 can be kept relatively stable. When changing from the directional drilling state to the compound drilling state, it is necessary to reduce the pump pressure. Under the action of the upper spring 13 and the lower spring 19, the spline sleeve 15 and the rotary control cylinder 12 move upward, and the position of the control pin 32 in the sliding path of the rotary control cylinder 12 moves from position C to position D. At this point, the drill string rotation controller is in an unstable un-meshed state. Then the pump pressure is increased, the rotary control cylinder 12 moves downward, the control pin 32 in the sliding path of the rotary control cylinder 12 moves from position D to position A, and the drill string rotation controller is in a stable meshing state.

The drill string rotation controller is subject to the anti-torque transmitted from the geological formation to the drilling tool during the rock breaking process (e.g., using the drill bit in the drilling tool controlled by the present drill string rotation controller). During compound drilling, since the drill string rotation controller spline group module is in the meshed state, the anti-torque is balanced by the upper drill string. During directional drilling, since the spline group module is un-meshed, the anti-torque needs to be balanced by the drill string rotation controller.

Figure 6:
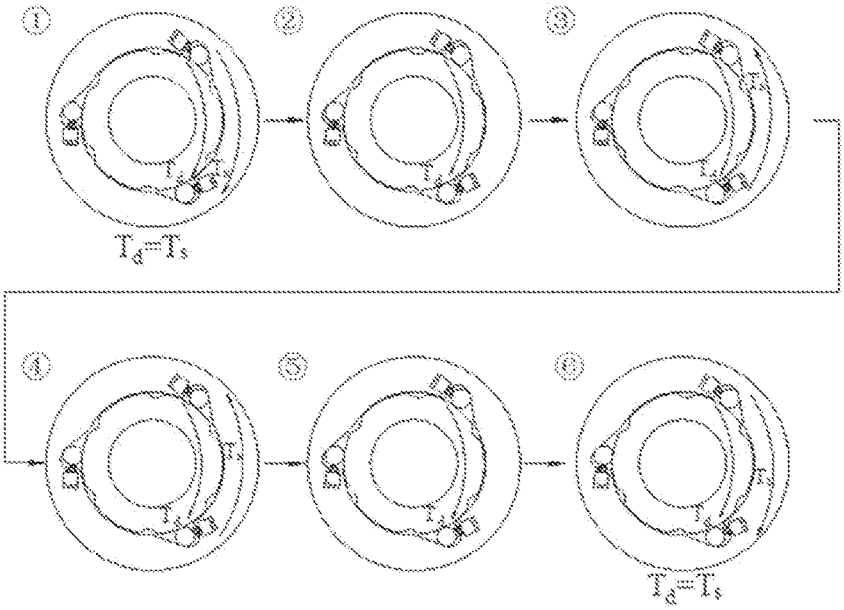
FIG. 6 is a schematic diagram of an anti-torque balance module in accordance with the present invention.

Referring to FIG. 6, the working process of the anti-torque balance module of the drill string rotation controller is as follows.

① In the initial state, the spline group module of the drill string rotation controller is meshed, and the mandrel (e.g., the upper mandrel 10, the spline mandrel 16 and/or the lower mandrel 21) and the shell (e.g., the roller shell 3, the upper shell 11, the spline shell 14, and/or the lower shell 17) rotate synchronously. The torque is equal (e.g., to the anti-torque).

② The spline group module of the drill string rotation controller is un-meshed. The roller shell 3 does not bear the anti-torque, the rotation of the mandrel (e.g., the upper mandrel 10, the spline mandrel 16 and/or the lower mandrel 21) is stably controlled, and the shell does not rotate.

③ The spline group module of the drill string rotation controller is un-meshed. The roller shell 3 bears the anti-torque, and the rotation of the mandrel (e.g., the upper mandrel 10, the spline mandrel 16 and/or the lower mandrel 21) is stably controlled. The shell has a reverse rotation tendency, but cannot be reversed. The driving torque of the mandrel is used to offset the anti-torque.

④ The spline group module of the drill string rotation controller is un-meshed. The roller shell 3 bears the anti-torque, and the drive torque of the mandrel (e.g., the upper mandrel 10, the spline mandrel 16 and/or the lower mandrel 21) is used to offset the anti-torque. At the same time, the drive torque of the mandrel is greater than the anti-torque, and the mandrel (e.g., the upper mandrel 10) presses the roller 29.

⑤ The spline group module of the drill string rotation controller is un-meshed, the roller shell 3 does not bear the anti-torque, the roller 29 is released by the mandrel (e.g., the upper mandrel 10), and the rotation of the mandrel (e.g., the upper mandrel 10) is stably controlled. The shell (e.g., the roller shell 3, the upper shell 11, the spline shell 14, and/or the lower shell 17) does not rotate.

⑥ The spline group module of the drill string rotation controller is meshed to stably control the synchronous rotation of the mandrel (e.g., the upper mandrel 10, the spline mandrel 16 and/or the lower mandrel 21) and the shell (e.g., the roller shell 3, the upper shell 11, the spline shell 14, and/or the lower shell 17), and the torque is equal (e.g., to the anti-torque).

The above content is merely an example to describe the structure of the present invention. Technical personnel in the technical field can make various modifications or additions to the specific embodiments described or use similar methods to replace them, as long as such modifications or additions do not deviate from the structure of the invention or go beyond the present invention, they shall all fall into the protection scope of the present invention defined by the claims of the invention.

What is claimed is:

1. A drill string rotation controller, comprising:

an anti-torque balance module including an upper joint, a wear ring, a roller shell, a shell joint, a roller, a roller spring, and a spring base, an upper bearing module including a TC (tungsten carbide) bearing retaining ring, an upper TC bearing, an upper thrust ball bearing, an upper Haval ring, and a middle sealing retaining ring, an upper mandrel, an upper shell assembly including an upper shell and a control cylinder module, wherein the control cylinder module comprises a rotary control cylinder, an upper spring, and a control pin, a spline group module including a spline shell, a spline sleeve, and a spline mandrel, a lower spring module including a lower shell, a spring push sleeve, and a lower spring, a floating piston, a lower mandrel, and a bulkhead, a lower bearing module including a lower thrust ball bearing, a lower Haval ring, and a lower TC bearing, and a conversion joint, an anti-drop joint, and a lower joint, wherein:

the anti-torque balance module is connected to the upper bearing module, the upper bearing module is connected to the control cylinder module, the upper shell is connected to the upper bearing module, the control cylinder module and the upper mandrel;

the upper mandrel is connected to the upper bearing module and the control cylinder module;

the control cylinder module is connected to the spline group module, the spline group module is connected to the lower spring module and the upper shell;

the lower spring module is connected the floating piston, the bulkhead, the lower mandrel and the lower bearing module;

the lower bearing module is connected to the conversion joint;

the conversion joint is connected to the anti-drop joint;

the anti-drop joint is connected to the lower joint;

the spline mandrel transmits a torque from an upper drill string to the spline sleeve, the spline sleeve transmits the torque to the spline shell, the rotary control cylinder (i) enables the spline group module to have an un-meshed state and a meshed state, so as to transmit or cut off the torque, and (ii) controls conversion of a composite drilling state and a sliding drilling state of the drill string rotation controller;

when the spline group module is in the meshed state, the drill string rotary controller performs compound drilling, and the anti-torque balance module does not bear an anti-torque; and when the spline group module is in the un-meshed state, the drill string rotation controller performs directional drilling, and the anti-torque balance module bears the anti-torque.

2. The drill string rotation controller according to claim 1, wherein the spline sleeve includes an inner spline and an outer spline, and when the spline group module is in the meshed state, the inner spline of the spline sleeve meshes with the spline mandrel, and the outer spline of the spline sleeve meshes with the spline shell.

3. The drill string rotation controller according to claim 2, wherein when the spline group module is in the un-meshed state, the inner spline of the spline sleeve is not meshed with the spline mandrel, and the outer spline of the spline sleeve is not meshed with the spline shell.

4. The drill string rotation controller according to claim 1, comprising a balance module including the roller, the roller spring and the spring base.

5. The drill string rotation controller according to claim 4, comprising a plurality of the balance modules.

6. The drill string rotation controller according to claim 5, wherein each of the plurality of the balance modules is distributed in the roller shell at an angle of 120° with respect to another one of the plurality of the balance modules.

7. The drill string rotation controller according to claim 5, wherein the roller shell bears the anti-torque when the upper drill string is operating to break one or more rocks.

8. The drill string rotation controller according to claim 1, wherein the upper bearing module and the lower bearing module separate rotation of at least one of (i) the roller shell, the upper shell, the spline shell and the lower shell from rotation of at least one of (ii) the upper mandrel, the spline mandrel, and the lower mandrel.

9. The drill string rotation controller according to claim 1, wherein the rotary control cylinder includes an upper end surface that can bear pressure, and movement and a position of the rotary control cylinder are restricted by the control pin.

10. The drill string rotation controller according to claim 1, comprising a spring system including the lower spring module and the upper spring.

11. The drill string rotation controller according to claim 10, wherein the lower spring module assists a reset operation.

* * * * *